US006672464B2

(12) United States Patent
Robertson

(10) Patent No.: US 6,672,464 B2
(45) **Date of Patent: *Jan. 6, 2004**

(54) DISPLAY SHELF TRACK DEVICE HAVING ATTACHING MEANS

(75) Inventor: James David Robertson, Atlanta, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/012,119

(22) Filed: Dec. 5, 2001

(65) Prior Publication Data

US 2002/0066706 A1 Jun. 6, 2002

Related U.S. Application Data

(63) Continuation-in-part of application No. 08/941,957, filed on Oct. 1, 1997, now abandoned, and a continuation-in-part of application No. 09/878,638, filed on Jun. 11, 2001, now Pat. No. 6,585,120, and a continuation-in-part of application No. 09/900,417, filed on Jul. 6, 2001, now Pat. No. 6,439,402.

(51) Int. Cl.[7] ..... A47F 1/04

(52) U.S. Cl. ..... 211/59.2; 211/74; 211/153; 211/181.1

(58) Field of Search ..... 211/59.2, 49.1, 211/181.1, 153, 74, 59.4, 134–135, 126.6, 184, 126.1, 183, 149, 133.5; 108/108, 60–61, 57.29, 57.16, 57.17, 57.33, 67, 157.15, 158.12; 206/561, 486, 562, 564, 557, 587

(56) References Cited

U.S. PATENT DOCUMENTS

| | | | | | |
|---|---|---|---|---|---|
| 3,320,011 | A | * | 5/1967 | Sachnoff et al. | 312/351 |
| 4,416,380 | A | * | 11/1983 | Flum | 211/181.1 |
| 4,890,746 | A | * | 1/1990 | Trulaske, Sr. | 211/153 |
| 4,923,070 | A | * | 5/1990 | Jackle et al. | 211/59.2 |
| 4,955,486 | A | * | 9/1990 | Trulaske, Sr. | 211/153 |
| 5,076,443 | A | * | 12/1991 | Trulaske, Sr. | 211/153 |
| 5,097,962 | A | * | 3/1992 | Eklof et al. | 211/59.2 |
| 5,645,176 | A | * | 7/1997 | Jay | 211/59.2 |
| 5,862,923 | A | | 1/1999 | Nordquist et al. | 211/59.2 |
| 5,992,650 | A | | 11/1999 | Lord | 211/59.2 |
| 6,082,557 | A | * | 7/2000 | Leahy | 211/184 |
| 6,135,297 | A | * | 10/2000 | DeShazo et al. | 211/189 |
| 6,237,784 | B1 | | 5/2001 | Primiano | 211/59.2 |
| 6,273,276 | B1 | * | 8/2001 | Upton et al. | 211/153 |
| 6,328,170 | B1 | * | 12/2001 | Lee | 211/153 |

* cited by examiner

*Primary Examiner*—Daniel P. Stodola
*Assistant Examiner*—Jennifer E. Novosad
(74) *Attorney, Agent, or Firm*—John L. James

(57) ABSTRACT

A display shelf track device has a downwardly protruding member for attaching the track device to the shelf. The downwardly protruding member can be a key, a plug or a clip. A clip forcibly fits over one or a pair of wires in a wire shelf or forcibly between wires to releasably attach the track device to the shelf. A plug forcibly fits into an opening in the shelf while a key fits in a keyway to immobilize the track device relative to the shelf.

2 Claims, 2 Drawing Sheets

DISPLAY SHELF TRACK DEVICE HAVING ATTACHING MEANS

CROSS-REFERENCE TO RELATED APPLICATIONS

This application is a continuation-in-part of Ser. No. 08/941,957 filed Oct. 1, 1997, now abandoned; Ser. No. 09/878,638 filed Jun. 11, 2001, now U.S. Pat. No. 6,585,120 and Ser. No. 09/900,417 Filed Jul. 6, 2001, now U.S. Pat. No. 6,439,402.

BACKGROUND OF THE INVENTION

This invention relates to a display device useful in merchandising articles having petaloid feet, and more particularly to a shelf device having an elongate channel for receiving petaloid foot articles for sliding movement therealong.

Display shelf devices with article-dispensing channels or track devices have been used in the merchandising of a number of products. These devices, typically, are supported on a shelf in a tilted condition and receive articles in rows so that the received articles slide or gravity feed one after another to the front of the device as the leading articles in each row are removed. While such conventional devices have experienced considerable success, they are not without disadvantages. Because the majority of commercial bottles and cans have cylindrical bodies, it is difficult to arrange bottles or cans on the devices at a predetermined orientation. More particularly, cylindrical articles tend to be placed at a random orientation and even to slowly rotate about their upright axes during their sliding movement along the devices. This results in the labels or the logos on the articles facing in different directions, which detracts from the appearance of the displayed articles. What is needed, therefore, is an improved display device which enhances the appearance of the articles displayed thereon.

Another problem with the devices is that they have a tendency to slide about on the shelf making loading and removing articles more difficult. It is highly desirable to have a display device that is anchored to the shelf.

SUMMARY OF THE INVENTION

The present invention is directed to overcoming one or more of the problems set forth above. According to one aspect of the present invention, a track device for a display shelf, wherein the display shelf has a front, a rear and a plurality of parallel wires extending between the front and rear, comprises a base member adapted to rest on the shelf and mean for releasably attaching the base to the shelf. When the attaching means includes a pair of parallel ribs protruding downward from the base member adapted to forcibly engage adjacent parallel wires of the shelf, the track device is releasably attached to the shelf. Releasable attachment is achieved by a force fit of the pair of ribs between adjacent wires and/or by a force fit of adjacent wires between the pair of ribs. When the attaching means includes a rib protruding downward from the base member and adapted to forcibly engage a single one of the parallel wires of the shelf, the rib has an engaging surface that has an arcuate cross-sectional configuration. The engaging surface may have a circular cross-sectional configuration of more than half a circle for releasably connecting the track device to the shelf.

According to another aspect of the invention, a track device for a display shelf, wherein the shelf has a front, a rear and at least one opening lying between the front and rear, comprises a base member adapted to rest on the shelf and means for releasably attaching the base to the shelf. The attaching means includes at least one rib protruding downward from the base member and adapted to forcibly engage the at least one opening in the shelf. The engagement of the rib and opening secure the track device preventing relative movement between the track device and shelf.

According to another aspect of the invention, a track device for a display shelf wherein the shelf has a front, a rear and at least one keyway lying between the front and rear comprises a base member adapted to rest on the shelf and attaching means, attached to the base member, for releasably attaching the base to the shelf. The attaching means includes at least one key protruding downward from the base member and adapted to engage the at least one keyway in the shelf to prevent relative movement between the track device and the shelf.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
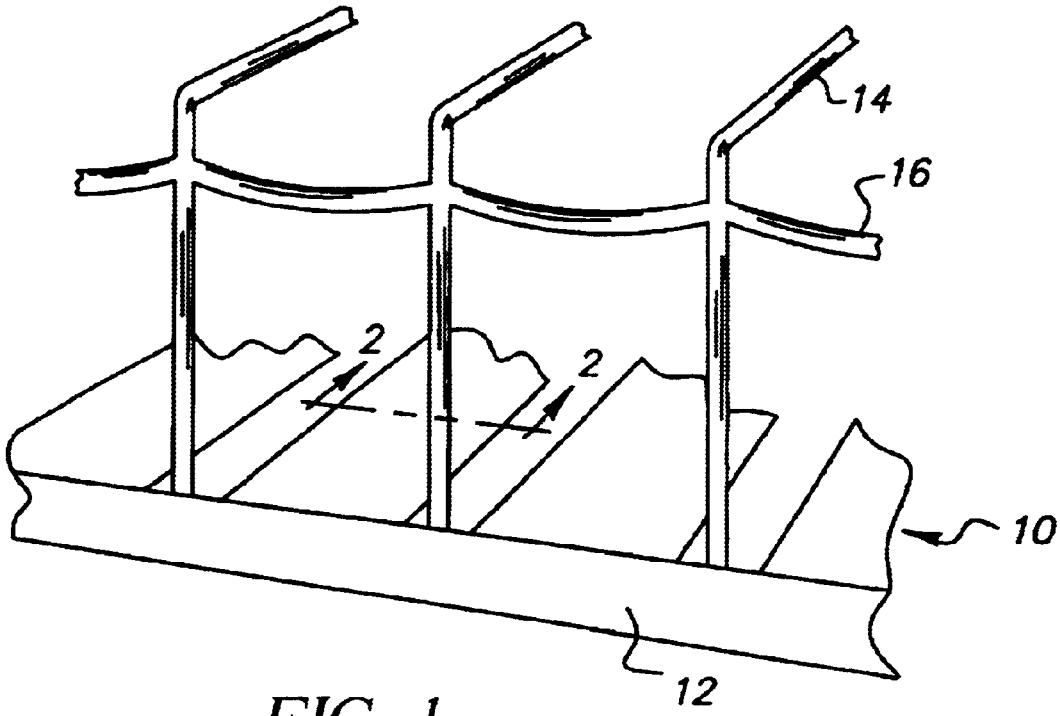
FIG. 1 is diagrammatic front view of a preferred embodiment of a beverage display shelf incorporating a display shelf track device according to the present invention.
Figure 2:
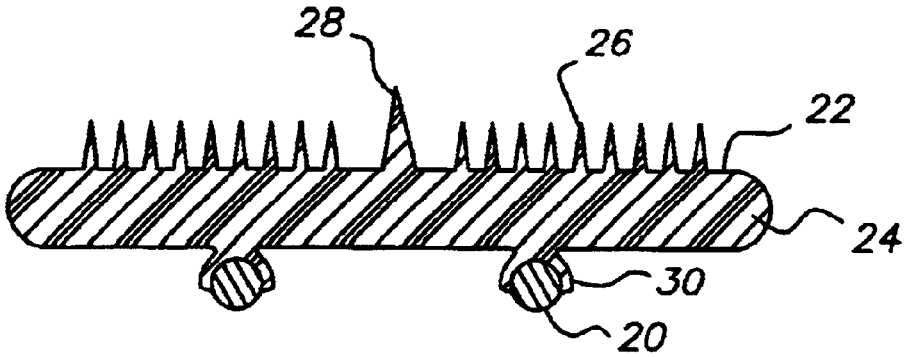
FIG. 2 is a cross-sectional view of a preferred embodiment display shelf track device attached to a wire shelf according to the present invention.

Referring to FIGS. 1–2, a display shelf 10 has horizontally extending front member 12 with a plurality of vertically extending wires 14 attached to the front member 12. A horizontally extending wire 16 is attached to each vertical wire 14 above front member 12. The vertical wires 14 turn rearward above horizontal wire 16 forming channels or tracks along which beverage container can reside for dispensing one at a time. Attached to front member 12 are a plurality of support wires 20 that are also attached to a rear member (not shown). Support wires 20 are preferably arranged in pairs or sets to provide support for the beverage containers.

A track device 22 rests on the wires and provides a broader base for the beverage bottles than the support wires 20. Track device 22 has a base 24 and preferably has a plurality of parallel ribs 26 upstanding from base 24. A product orienting rib 28 is upstanding from the base 24 for preventing rotation of the product container. Such product orienting ribs are more fully described in U.S. Pat. No. 6,237,784 and co-pending applications Ser. Nos. 08/941,957; 09/878,638 and 09/900,417, the disclosures of which are incorporated herein by reference.

As is apparent, the base 24 would have a tendency to slide about on the support wires 20, especially laterally, because the track devices do not completely fill the shelf area. Track devices only need a width sufficient to support the product containers and to rest on the support wires. The present invention provides a means for releasably connecting base 24 to support wires 20 to prevent relative movement between the base and support wires. This is accomplished by a rib 30 protruding downward from base 24. Rib 30 is bifurcated providing a pair of outside engaging surfaces. The rib 30 is adapted to forcibly engage one of the parallel support wires 20. The engaging surface has an arcuate cross-sectional configuration and preferably has a circular cross-sectional configuration of more than half a circle. There may be a single rib for the track device 22 or one rib for each support wire.

Figure 3:
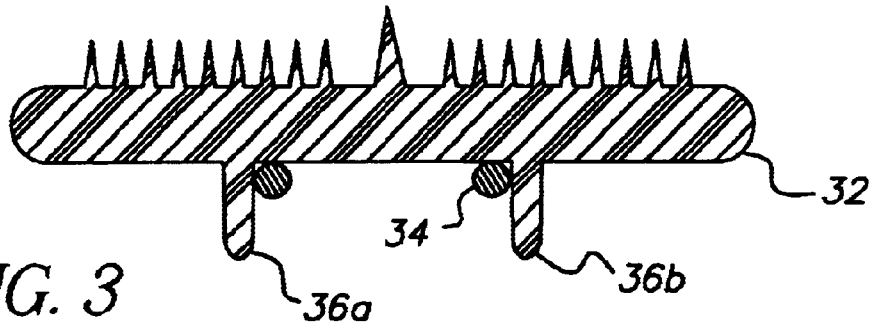
FIG. 3 is a cross-sectional view similar to FIG. 2 but illustrating another preferred embodiment.

Referring to FIG. 3, the means for releasably connecting base 32 to support wires 34 employs a pair of parallel ribs 36*a,* 36*b* protruding downward from base 32. Each of the ribs 36*a,* 36*b* of the pair of parallel ribs have an outside engaging surface and an inside engaging surface. The inside engaging surfaces lie between the outside engaging surfaces. The parallel ribs 36*a*, 36*b* are adapted to forcibly engage a pair of the parallel wires 34 so that the track device fits over the wires with the wires between the ribs. The fit is a force fit so that relative lateral movement is prevented. The parallel wires so engaged may be adjacent one another or nonadjacent.

Figure 4:
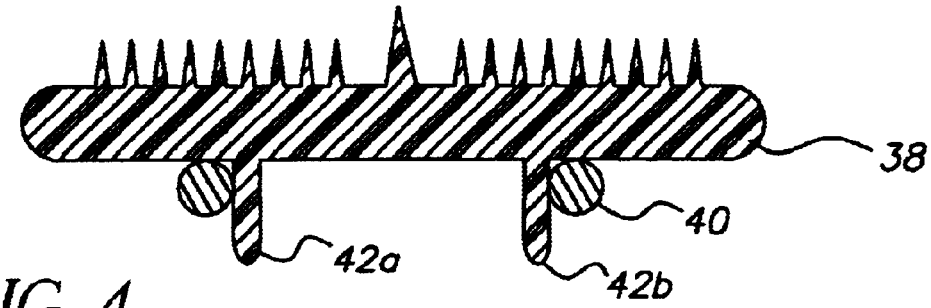
FIG. 4 is a cross-sectional view similar to FIGS. 2 and 3 but illustrating another preferred embodiment.

Referring to FIG. 4, the means for releasably connecting base 38 to support wires 40 employs a pair of parallel ribs 42*a,* 42*b* protruding downward from base 38. Each of the ribs 42*a,* 42*b* of the pair of parallel ribs have an outside engaging surface and an inside engaging surface. The inside engaging surfaces lie between the outside engaging surfaces. The parallel ribs 42*a,* 42*b* are adapted to forcibly engage a pair of the parallel wires 40 so that the track device fits over the wires with the ribs between the wires. The fit is a force fit so that relative lateral movement is prevented. The parallel wires so engaged may be adjacent one another or nonadjacent.

Figure 5:
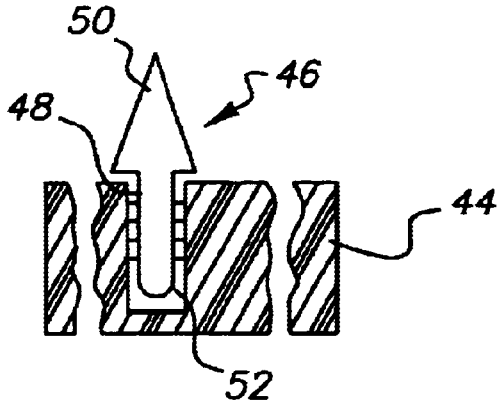
FIG. 5 is a cross-sectional view of a preferred embodiment display shelf track device attached to a plastic shelf according to the present invention.

Referring to FIG. 5, a display shelf 44 has a plastic bottom for supporting the beverage containers. The shelf has a front, a rear and at least one opening lying between the front and rear. The track device 46 has a base member 48, at least one rib 50 upstanding from base member 48 and means for releasably attaching the base member to the shelf. The attaching means includes at least one rib 52 protruding downward from base member 48 and adapted to forcibly engage the at least one opening in the shelf. The force fit keeps the track device from moving laterally relative to the shelf. The track device may be a wide, elongated device similar to the devices of FIGS. 2–4, or may be a narrower device just wide enough to support the upstanding rib. The at least one opening in the shelf may be a slot to accommodate such a narrower device.

Figure 6:
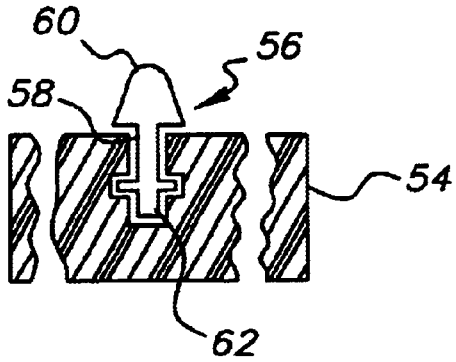
FIG. 6 is a cross-sectional view similar to FIG. 2 but illustrating another preferred embodiment.

Referring To FIG. 6, the shelf 54 has a front, a rear and at least one keyway lying between the front and rear. The track device 56 has a base member 58, at least one rib 60 upstanding from base member 58 and means for releasably attaching the base member to the shelf. The attaching means includes at least one key 62 protruding downward from base member 58 and adapted to engage the keyway in the shelf. The keyway extends longitudinally from front to rear and keeps the key, and attached track device, from moving laterally relative to the shelf. The track device may be a wide, elongated device similar to the devices of FIGS. 2–4, or may be a narrower device just wide enough to support the upstanding rib.

It can now be appreciated that a display shelf track device has been prevented that has means for releasably connecting the track device to the shelf to prevent relative movement between the track device and shelf. The track device has a downwardly protruding member for attaching the track device to the shelf. The downwardly protruding member can take the form of a bifurcated rib with an engaging surface that fits about one of the parallel support wires of the shelf. It can also take the form of a pair of ribs that fit support wires between them, or tat fit between two support wires. The support wires are preferably adjacent one another but adjacency is not necessary to achieve a force fit, be a key, a plug or a clip. Where a plastic shelf is used instead of a wire shelf, a plug can be used and forcibly fit into an opening in the shelf. Alternatively, a key may be used to fits into a keyway in the shelf to immobilize the track device relative to the shelf.

While the invention has been described with particular reference to the preferred embodiments, it will be understood by those skilled in the art that various changes may be made and equivalents may be substituted for elements of the preferred embodiments without departing from invention. It is accordingly intended that the claims shall cover all such modifications and applications as do not depart from the true spirit and scope of the invention.

What is claimed is:

1. A track device and a display shelf, said display shelf having a front, a rear and a plurality of parallel wires extending between the front and rear, said track device adapted to receive a row of articles for sliding movement therealong, each article having a bottom with a groove therein, said track device comprising:

a base member adapted to rest on the shelf;

a plurality of parallel ribs upstanding from said base member, said ribs having tops defining a plane;

at least one article orienting rib upstanding from said base member and extending above said plane, said article orienting rib being adapted to prevent rotation of the articles by being adapted to engage said groove in each of the articles as the articles slide along the track device; and means, attached to said base member, for releasably attaching said base member to at least one of said parallel wires of said shelf, said base member being supported on said parallel wires of said display shelf solely by said means, said means including at least one rib protruding downwardly from said base member and having an engaging surface arcuate in cross-sectional configuration, said at least one rib adapted to forcibly engage a top surface of a single one of said parallel wires.

2. A track device, as set forth in claim 1, wherein said engaging surface has a circular cross-sectional configuration of more than half a circle.

* * * * *